US009561951B2

(12) United States Patent
St. Louis

(10) Patent No.: US 9,561,951 B2
(45) Date of Patent: Feb. 7, 2017

(54) TAIL SET CRUPPER

(71) Applicant: Donna St. Louis, Pefferlaw (CA)

(72) Inventor: Donna St. Louis, Pefferlaw (CA)

( * ) Notice: Subject to any disclaimer, the term of this patent is extended or adjusted under 35 U.S.C. 154(b) by 110 days.

(21) Appl. No.: 14/073,253

(22) Filed: Nov. 6, 2013

(65) Prior Publication Data

US 2015/0121817 A1 May 7, 2015

(51) Int. Cl.
*B68B 3/16* (2006.01)

(52) U.S. Cl.
CPC ..... *B68B 3/16* (2013.01)

(58) Field of Classification Search
CPC ..... B68B 3/16; B68B 5/04; B68B 5/00
See application file for complete search history.

(56) References Cited

U.S. PATENT DOCUMENTS 408,340 A * 8/1889 Ellis ..... 54/78
458,674 A * 9/1891 Ellis ..... 54/22
899,661 A * 9/1908 Ellis ..... 54/22
1,563,841 A * 12/1925 Ellis ..... 54/22
1,991,299 A * 2/1935 Swaggerty ..... 54/22
2,128,498 A * 8/1938 Ottley ..... 54/78
2,487,005 A * 11/1949 Walker ..... 54/78
2,508,117 A * 5/1950 Lavery, Sr. ..... 54/78
3,534,527 A * 10/1970 Miller ..... 54/22
6,408,603 B1 * 6/2002 Babuik ..... 54/78
6,993,892 B2 * 2/2006 St. Louis ..... 54/22

* cited by examiner

*Primary Examiner* — Kathleen Alker
(74) *Attorney, Agent, or Firm* — Kenneth L. Bousfield; Bereskin & Parr LLP/S.E.N.C.R.L., s.r.l.

(57) ABSTRACT

A tailset crupper for an animal, such as a horse, may be made from a solid casting without lightening features, such as to produce a heavier, less easily dislodged object, such as may have a lower center of gravity, and a center of gravity located closer to the surface of the animal. The trough of the crupper may be predominantly open from below. The distal end of the crupper may have a large curl the bends on a large angle partially back toward the horse. The crupper may be substantially spoonless. That is, the protrusion at the front end of the crupper may be small, and may by shy of the cushioning on either side.

17 Claims, 9 Drawing Sheets

TAIL SET CRUPPER

FIELD OF THE INVENTION

This invention relates to the field of tail set cruppers.

BACKGROUND OF THE INVENTION

A tail set crupper is a portion of a harness for an animal, such as a horse, that is used to encourage the tail to be maintained in an arched shape. It may be worn by the animal for extended periods of time. After a period of use, the crupper may tend to cause the tail to be straightened relative to the direction of the spine of the animal, and also to extend on a relatively upstanding, arcuate shape, such that the tail may take on the desired "set", hence the "tail set" crupper. A horse, or other animal, may find the crupper uncomfortable. Consequently, the horse may make repeated efforts to dislodge the crupper. In the view of the present inventor, horses often are, or become, quite adept at dislodging the crupper. It might therefore be advantageous to have a crupper that might tend either to be more comfortable, or less easily dislodged, or both. The specification and drawings of U.S. Pat. No. 6,993,892 are incorporated herein by reference.

SUMMARY OF THE INVENTION

In an aspect of the invention there is a crupper. There is a base portion and a trough portion. The base portion has a first surface for placement next to the hindquarters of an animal. A trough portion is joined to the base portion. The trough portion, in use, extends outwardly away from the animal. The trough portion has a first end adjoining the base portion, a second end distant from the base portion and an intermediate portion between the first and second ends. The second end of the trough portion has a rounded mouth. The trough has a medial portion between the first end and the second end, the medial portion being predominantly downwardly open.

In a feature of the aspect of the invention, the trough portion has a spine extending therealong, and apertures are formed in the trough portion adjacent to the spine, the spine being narrower than the apertures. In another feature, the trough portion has a central spine and a cross-rib extending between the first end and the second end, and is otherwise downwardly open. In yet another feature, the rounded mouth defines a continuous imperforate rounded surface. In still another feature, the crupper has a central longitudinal plane, and the crupper has the rounded mouth presents a continuous rounded surface over a sweep in the central longitudinal plane of more than 2(Pi)/3 radians. In an additional further feature, the crupper has an outlet tangent portion extending away from the continuous rounded surface.

In a still further feature, the crupper is substantially spoonless. In another feature, the base portion and the trough portion are joined as parts of a single casting, the base portion including left and right hand pads located to either side of the first end of the trough. The first and second pads have a through-thickness measured to the trough. The first end of the trough extends a distance less than the through-thickness proud of the first and second pads. In another feature, the first end of the trough is free of upward slope deviation.

In another aspect of the invention there is a tail set crupper. It has a base portion and a trough portion. The base portion has a first surface for placement next to the hindquarters of an animal. The trough portion is immovably joined to the base portion, the trough portion, in use, extending outwardly away from the animal. The trough portion has a first end adjoining the base portion, a second end distant from the base portion and an intermediate portion between the first and second ends. The first end of the crupper being substantially spoonless.

In a feature of that aspect of the invention, the base portion has a through-thickness adjacent to the trough, and the first end of the trough extends a distance less than the through-thickness proud of the pads. In another feature, the base portion has cushioning applied thereto, and the cushioning stands proud of the first end of the trough. In another feature, the first end of the trough is free of upward slope deviation. In still another feature, the intermediate portion of the trough is downwardly vented.

In another aspect of the invention there is a tail set crupper. It has a base portion and a trough portion. The base portion has a first surface for placement next to the hindquarters of an animal. The trough portion is immovably joined to the base portion. The trough portion, in use, extends outwardly away from the animal. The trough portion has a first end adjoining the base portion, a second end distant from the base portion and an intermediate portion between the first and second ends. The crupper has a mouth at the second end thereof, the mouth has the form of a channel defining continuous support surface, the channel being formed on a curve turned partially back toward the base.

In a feature of that aspect, the curve of the channel is formed on a curl greater than 2(Pi)/3 radians. In another feature, the mouth terminates at a tangentially extending cuff. In a further feature, the channel is at least ⅖ as deep as it is wide. In another feature, the trough portion is downwardly vented. In another feature, the crupper is substantially spoonless.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION OF THE INVENTION

Figure 1:
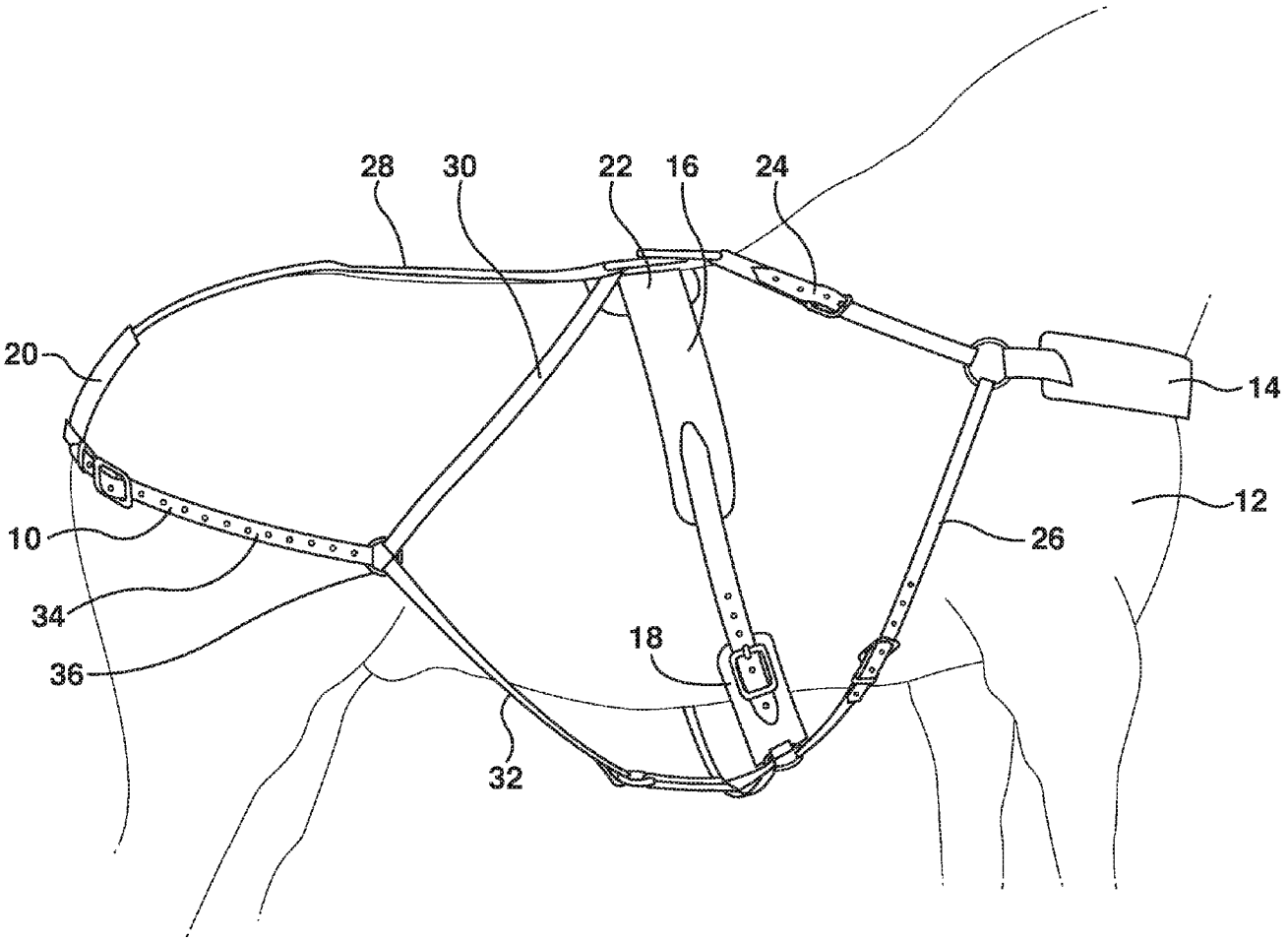
FIG. 1 shows the general arrangement of a harness on a horse, in side view, including the general positioning of a crupper according to the principles of the present invention.
Figure 2:
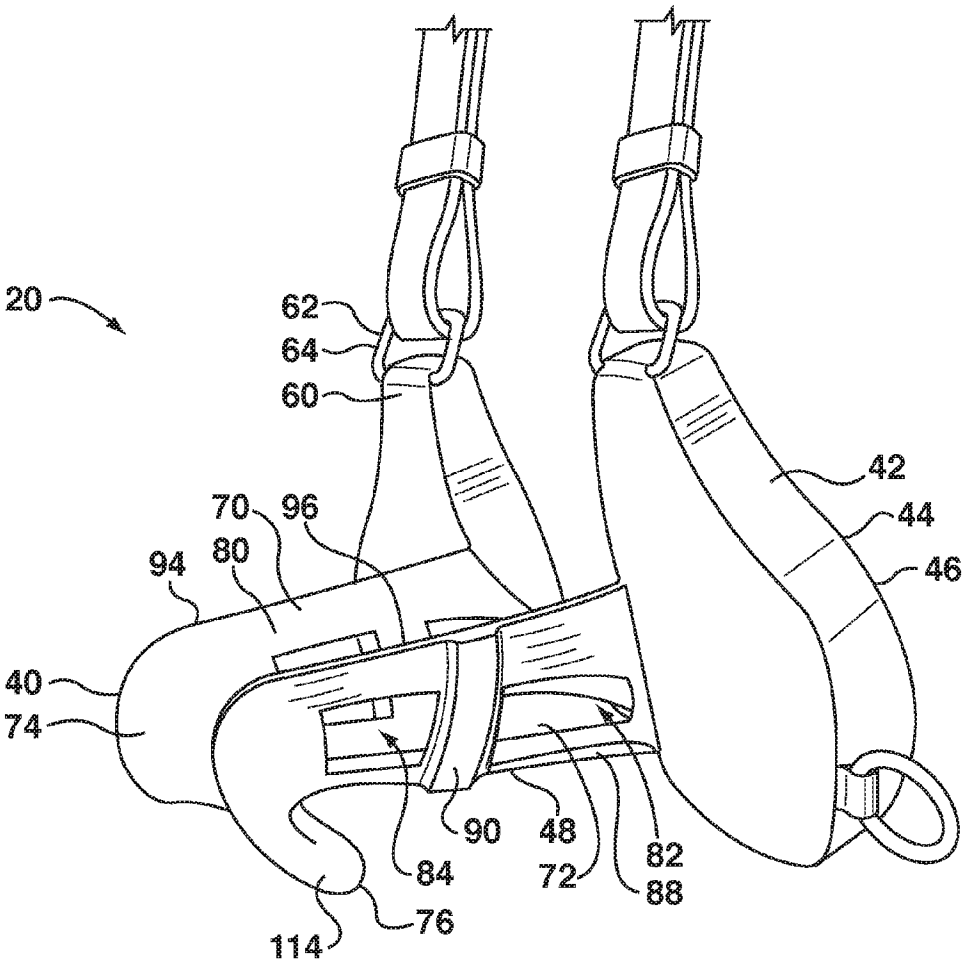
FIG. 2 shows a perspective view of a crupper, with padding, ready for mounting on the horse of FIG. 1.

The description that follows, and the embodiments described therein, are provided by way of illustration of an example, or examples of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

By way of a general overview, FIG. 1 shows a harness 10 for an animal, such as a horse 12. Harness 10 may include a breast collar 14 that extends about the fore quarters of the horse beneath the base of the neck, a sursingle 16 and crupper assembly 20. Sursingle 16 extends about the girth of horse 12, and includes a sursingle belly band 18 that extends beneath the horse's belly and a sursingle back 22 that extends over the horse's back. Breast collar 14 is maintained in position relative to sursingle 16 by upper and lower breast collar straps indicated respectively as 24 and 26. Crupper 20 is mounted to the rear end of horse 12, and may be maintained in position by a pair of turnback straps 28 that extend from the top of the sursingle, over the hindquarters of the horse, and which connect to the top or upper portion of crupper assembly 20, as is more fully described below. Turnback straps 28 are adjustable in length, and so govern the longitudinal distance along the back of horse 12 between the top of sursingle 16 and crupper 20. Lateral position of crupper assembly 20 may tend to be maintained by the use, and suitable adjustment, of upper, lower, and rearward spider straps 30, 32, and 34. Upper spider strap 30 runs from the top of sursingle back 22 generally rearwardly and diagonally to a node, or ring, 36. Lower spider strap 32 runs from a D-ring at one end of the center portion of the bottom of sursingle belly band 18, generally diagonally upwardly and rearwardly to ring 36. Rear spider strap 34 runs rearwardly about the contours of the flank of horse 12 to attach to crupper assembly 20, described below. While right hand straps are visible in the figure, corresponding left hand spiders straps extend on the opposite side of horse 12 such that the forces in the straps relative to the lateral positioning of crupper assembly 20 may tend to be more or less symmetrically balanced and crupper assembly 20 may tend to be maintained in a central position to support the horse's tail in general longitudinal alignment with the spine of the horse (which, for the purposes of this description lies ideally in a fore-and-aft longitudinal vertical plane).

Crupper assembly 20 may include a crupper frame, referred to hereinafter simply as crupper 40, discussed in greater detail below, padding 42, and a leather cover 44. Crupper 40 has a compound concave surface that is fabricated to conform to the compound curvature of a horse's hindquarters adjacent to the root of the spine. Padding 42 is mounted to sit between the curvature of crupper 40 and the skin of horse 12. For other animals, a different curvature may be used, such as may correspond to the customary shape of that animal. Leather cover 44 is sewn to padding, the whole assembly of cover and padding fitting over the greater part of crupper 40. The terminology "crupper" may, depending on context, refer to either the entire assembly, i.e., crupper assembly 20, or more specifically, to the rigid crupper frame, i.e., designated as crupper 40, alone.

The illustrations provided herein are based on photographic views of an example of a crupper 40. Crupper 40 may be fabricated from a metal, such as aluminium, but may also be fabricated from other suitable materials. In general, crupper 40 may have a vertical-longitudinal plane of symmetry, allowing for the asymmetries and imperfections in production of castings, and, in particular, of sand castings.

Although crupper 40 may be formed as an integral, monolithic casting, crupper 40 can be thought of as having a base, or base portion, or base, 46, and a trough portion, or trough 48. In general terms, base portion 46 has a pair of left and right hand pad portions, 50, 52 joined by a U-shaped web portion 54.

Pad portions 50 and 52 may each have a contoured inward surface 56, 58 that may be formed on a compound concave curvature, that is generally symmetrical about a vertical longitudinal central plane bi-secting trough portion 48, the two compound curved surfaces tending to lie on the same geometric surface, the curvature being intended to permit crupper 40 to conform, in a general sense to the curvature of the hindquarters of the animal, such as horse 12, or as the case may be. The compound curvature may be formed according to a geometric polynominal function, or may be formed on radii of curvature about respective vertical and transverse axes, the resultant compound curvature being formed generally to conform to the shape of a horse's hind quarters. To that end, the transverse radius of curvature may be of the order of 80 to 100 inches, and may be about 90 inches (+/−5"); the vertical radius of curvature may be of the order of 10 to 15 inches, and may be approximately 11½ inches (+/−1 inch). The resultant surface may tend to be an ellipsoid, or a reasonably close approximation of an ellipsoid given the possible imprecision of a sand casting, if such is employed. That is, the surfaces of the two pad portions 50, 52 would then be portions lying on the same ellipsoidal surface. Put alternately, the two surfaces may tend to lie on a common torus (i.e., doughnut) surface, where, converting the radii above, the main radius of the torus may be about 75 to 80 inches in the horizontal plane, and the minor radius of the torus may be about 10 to 15 inches. While it is desirable for this curvature to conform closely to the size of the hindquarters of horse 12, a layer of padding 42 may generally be placed between the surface of the crupper frame pad portions 50, 52, and may tend to take up a reasonable degree of imprecision.

Figure 3A:
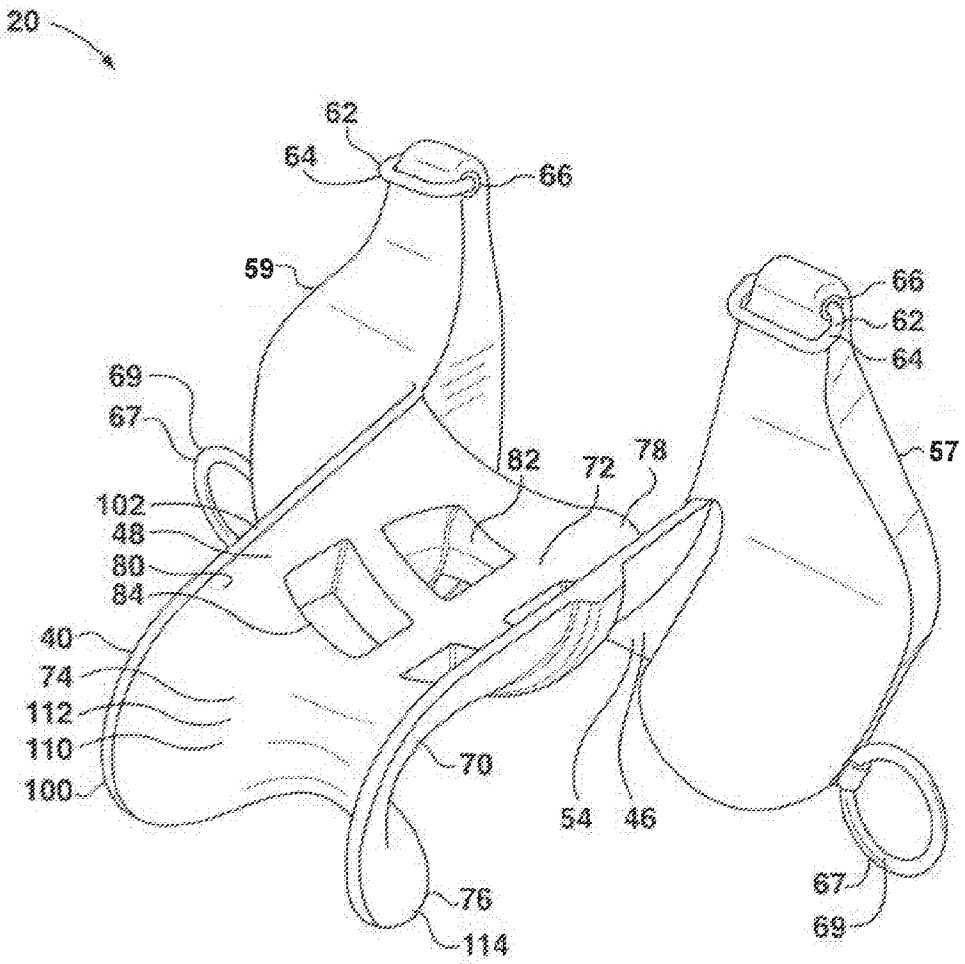
FIG. 3*a* shows a perspective view of the crupper of FIG. 2*a*, without padding or leather cover taken from above, behind, and to the right.
Figure 3B:
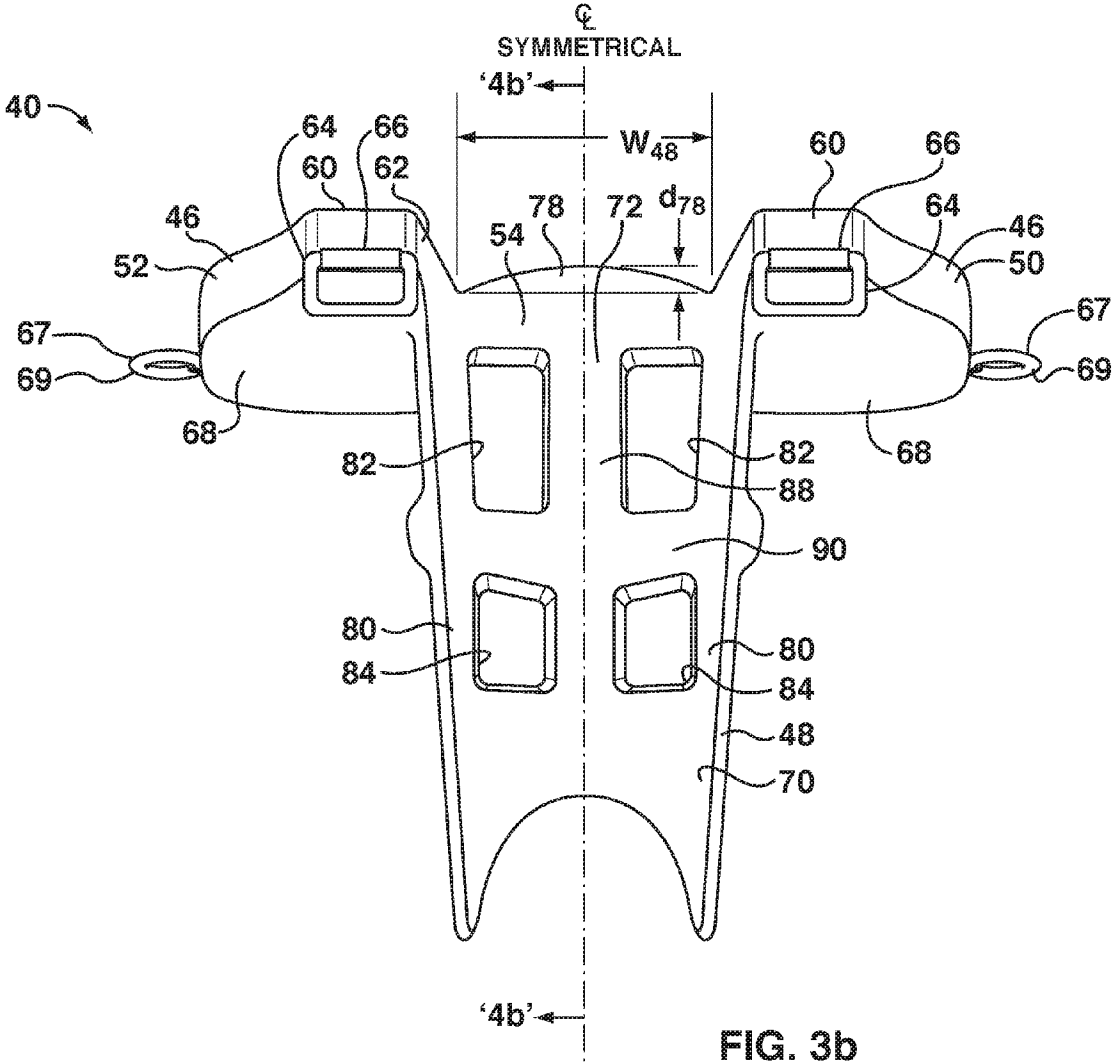
FIG. 3*b* shows a top perspective view of the crupper of FIG. 3*a* without padding.
Figure 3C:
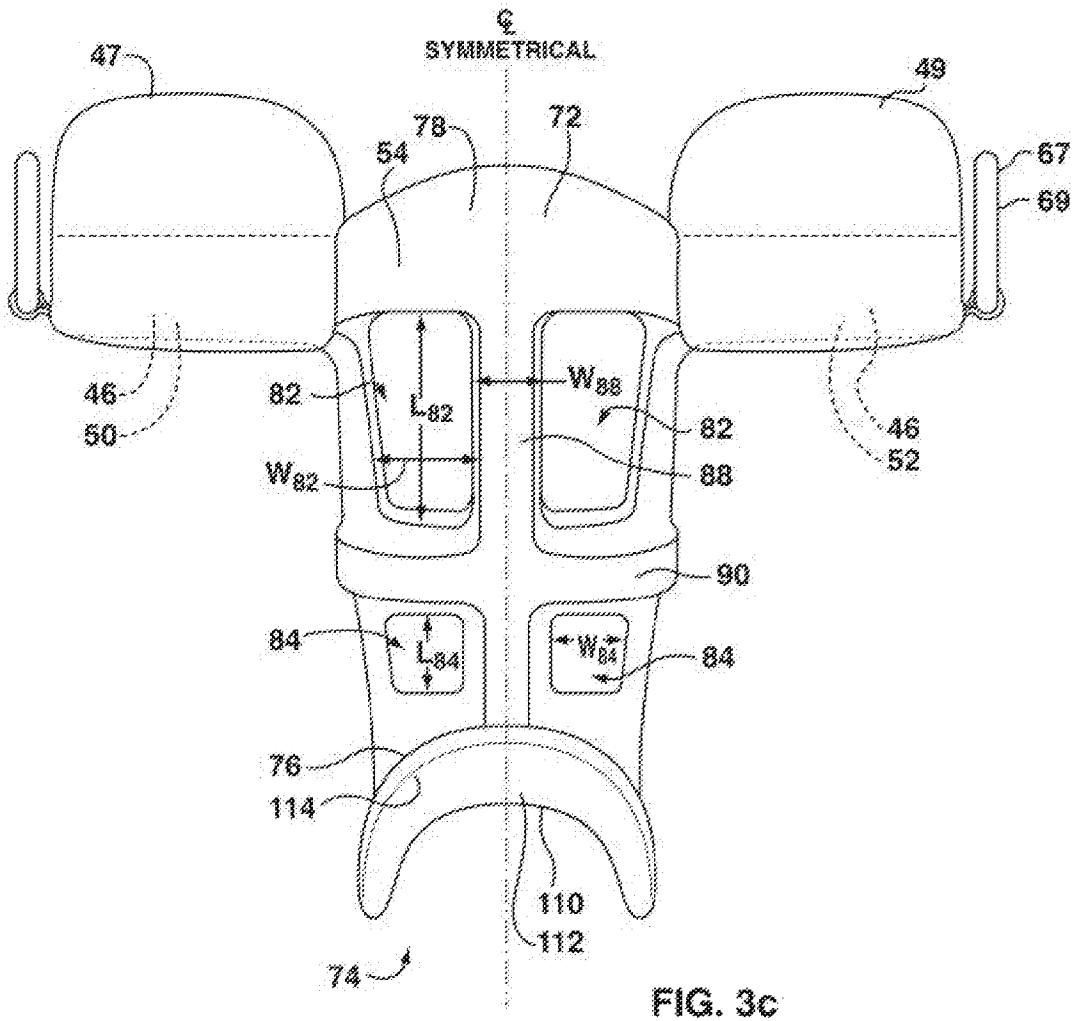
FIG. 3*c* shows a bottom perspective view of the crupper of FIG. 3*a* with padding.
Figure 3D:
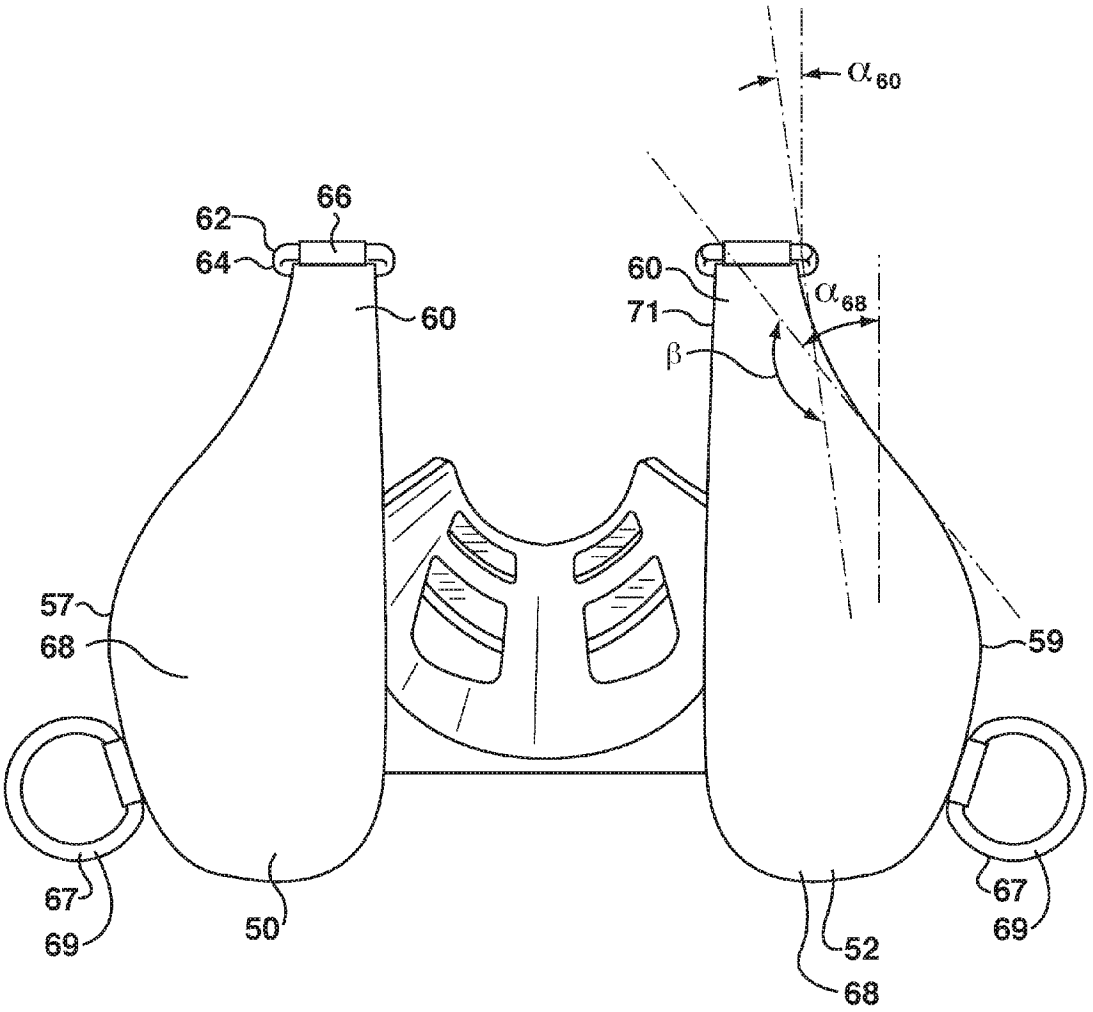
FIG. 3*d* shows a front perspective view of the crupper of FIG. 3*a* without padding.
Figure 3E:
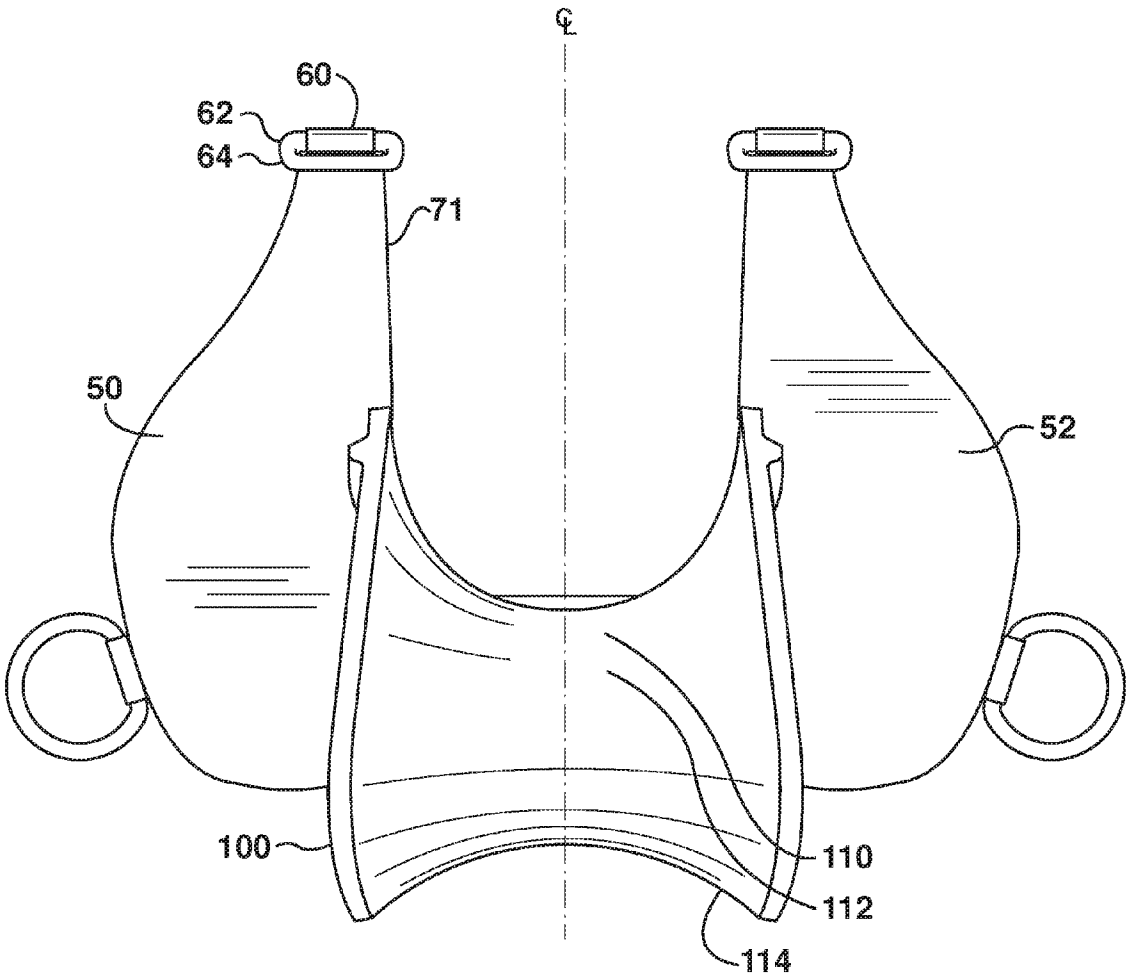
FIG. 3*e* shows a rear perspective view of the crupper of FIG. 3*a* without padding.

In one embodiment, the U-shaped web portion 54 may tend to have quite a square-cornered, or three-sides-of-the-rectangle appearance, with slightly splayed legs. The splay may be about .+−0.2 inch in width over about a 4 inch rise in height, giving a splay angle of about 3 to 4 degrees from either side of vertical for the respective sides, if the back portion is taken as being substantially horizontal in terms of the view shown in FIG. 3*d*. The back of this web portion 54 is sometimes referred to as the "bridge" between the left and right hand pad portions 50, 52.

Figure 4A:
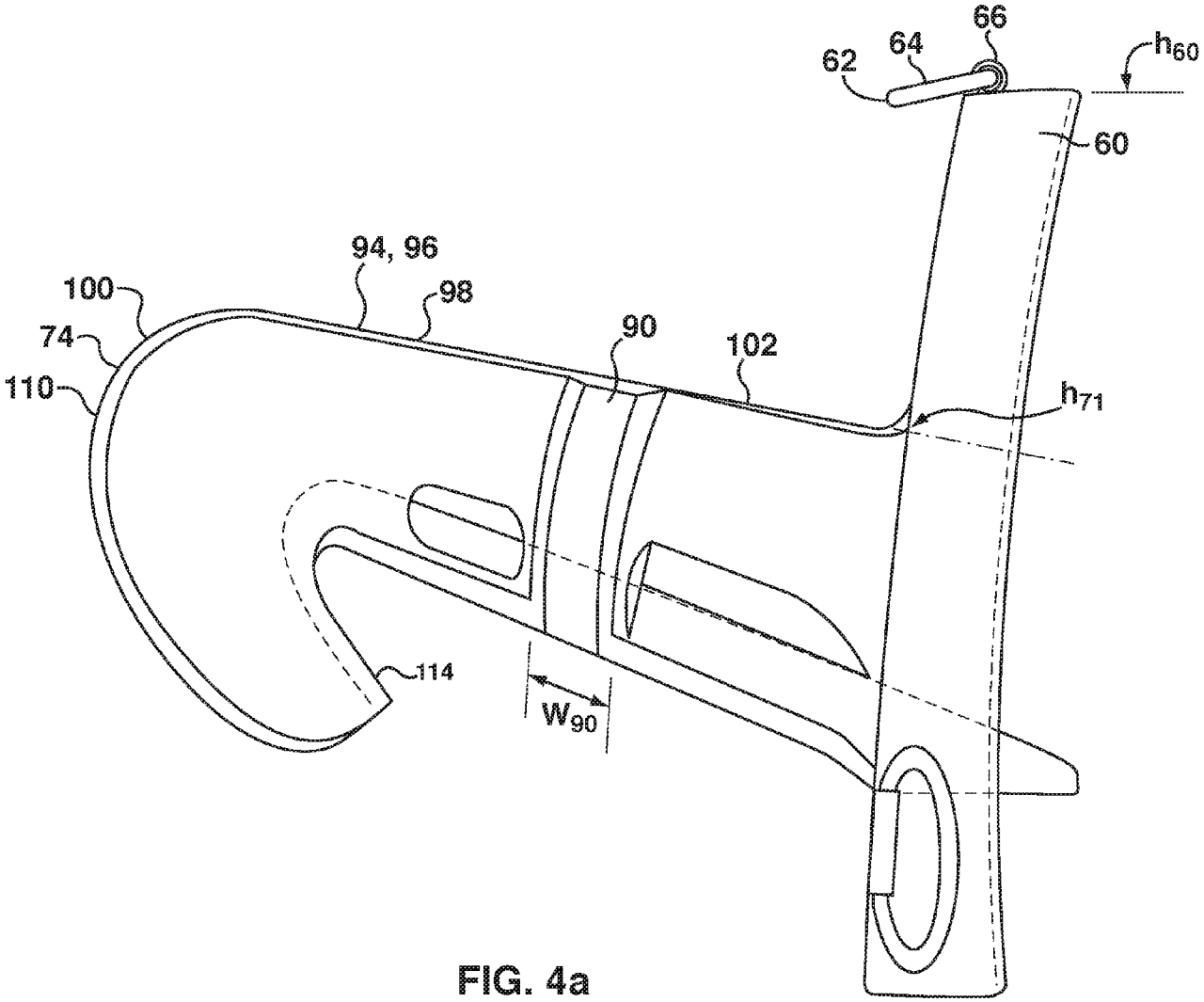
FIG. 4*a* shows a side perspective view of the crupper of FIG. 3*a*.
Figure 4B:
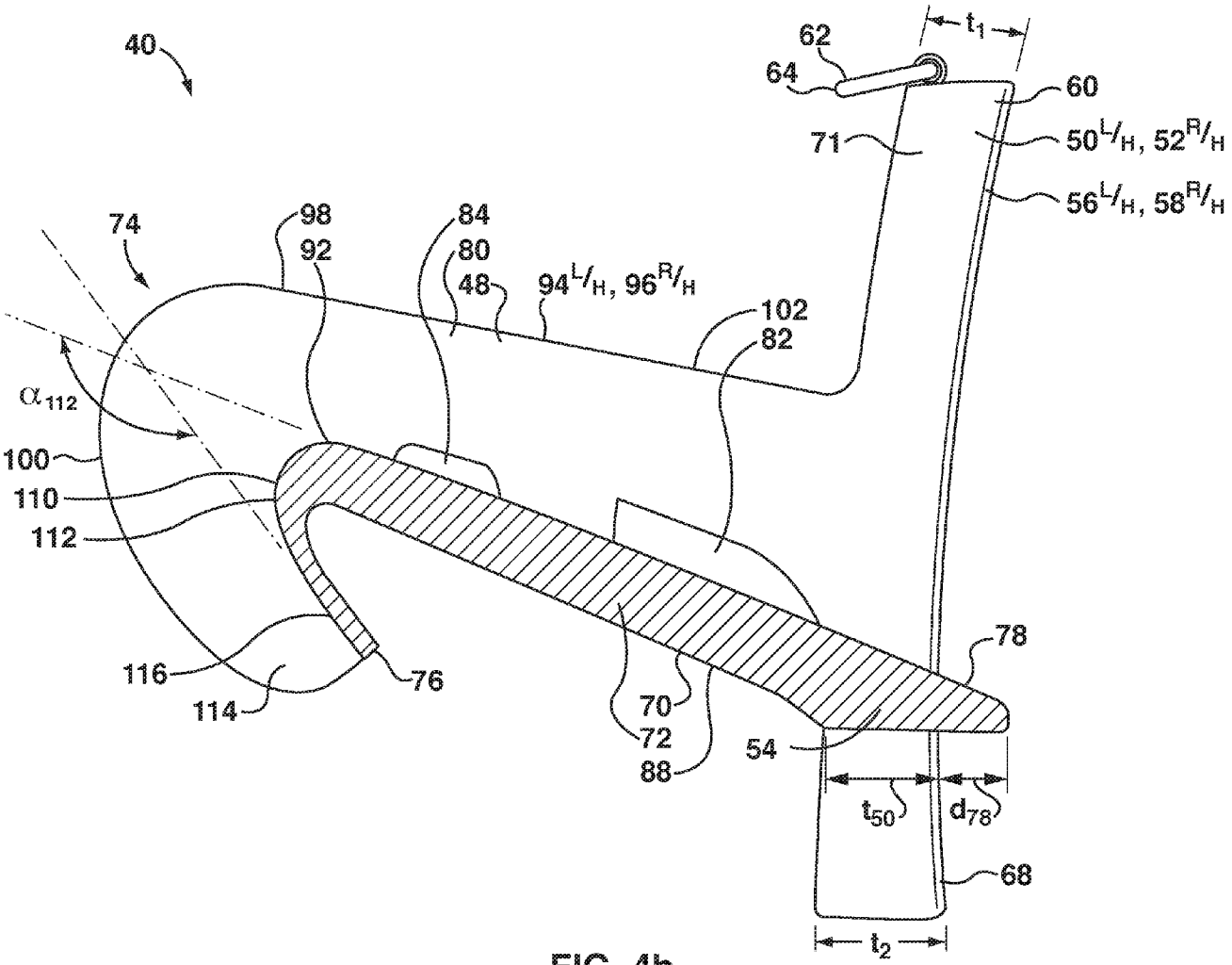
FIG. 4*b* shows a cross-sectional view taken along the longitudinal centerline of the crupper of FIG. 3*a*, indicated by section '4*b*-4*b*' of FIG. 3*b*.

Each of the pad portions 50, 52 may have a lower, rather wider region 68, that may be smoothly radiused along the laterally outboard portions at its upper end to give onto an upper, narrowing region or tail, or toe 60 (left or right hand, respectively). At the distal or upper extremity of each tail, or toe 60, is a strap attachment fitting 62, such as a rectangular ring, or eye, 64, whose hinge fitting 66 may be riveted in place. Given that the general use environment may tend to be acidic, mechanical fasteners in the nature of galvanically suitable rivets may be used, such as copper rivets being used in an aluminum casting with stainless steel hinge fittings, for example. The lower lobate regions 68 of pads 50, 52 also have mounting fittings 67, such as may be in the nature of hingedly mounted ring fittings 69 that may be mounted to the laterally outermost extremities of the outer surface 57, 59 of the wings (namely lobate regions 68) of crupper 40. Fittings 67 may be employed as connection points for rearward spider straps 34, whereby the lateral positioning of crupper 40 may be adjusted. In the embodiment shown, and in contrast to the crupper shown in FIG. 4*a* of U.S. Pat. No. 6,993,892, toe 60 is formed into a less sharp or pointed form, but rather retains a broader, more gently curved form to a relatively higher location such as may tend to increase the upper surface area, and spread, of the crupper, such as may be more comfortable for the animal. In the embodiment shown, the tangent of the uppermost slope portion of the outside edge of the crupper is shown as $alpha_{60}$. The maximum inward slope angle (taken at the tangent of the point of inflection of the transition, as indicated at $alpha_{68}$ forms an intersection angle identified as beta. In the embodiment of U.S. Pat. No. 6,993,892, the corresponding angle is quite pronounced, being less than ¾(Pi) radians, such that toe 60 is relatively long and thin. If the inside edge 71 of toe 60 is taken as a first datum, In U.S. Pat. No. 6,993,892 the intersection at angle beta is located less than halfway from the trough transition (i.e., the height $h_{71}$ at which tangent 102 intersects pad portion 50, 52, as may be) to the uppermost tip $h_{60}$ of toe 60. By contrast, in the embodiment described herein, that point of intersection lies more than halfway toward datum toe 60, and may be more than ¾ of the way. Further, the angle of intersection is well more than ¾(Pi) radians and may be more than ⅚(Pi) radians. Expressed differently, toe 60 in U.S. Pat. No. 6,993,892 has a significantly higher aspect-ratio of length to width from the inflexion point to the tip, being roughly 3:1, whereas toe 60 herein has an aspect ratio of less than 3:1, and which may be less than 2:1. As can be seen, the slope at the point of inflexion is also correspondingly shallower. Each of these measures is a proxy for the qualitative difference of the pads being fatter further upward to spread load.

The outer surfaces 57, 59 of pad portions 50, 52 may also be curved, but in such a way that the through thickness $t_1$ at the extremity of toes 60 may be substantially less than the through thickness $t_2$ at the lowest extremity of lobate regions 68. For example, the upper thickness may taper to thickness $t_1$ of about half an inch, or less. The lower thickness may broaden to thickness $t_2$ of roughly about an inch (+/−⅛"), and the variation in thickness may be a smoothly continuous increase as a function of position along the arc. This may tend to result in a disproportionate biasing of the weight distribution of the pads toward the lower extremity.

Trough portion 48 may include an outboard, or rearward portion 70 that, in use, extends outwardly and upwardly away from the hind quarters of the animal, and an inward portion, 72 that extends inwardly of the surface of the body of revolution on which surfaces 56 and 58 of pad portions 50 and 52 are formed. Rearward portion 70 has the form of a nozzle or chute. Rearward portion may taper from its base (next to the animal) to its distal end. At its broad, proximal end adjacent pad portions 50, 52 rearward portion forms a smooth transition into the web, or bridge portion 54 of base portion 46. At the distal end of rearward portion 70, the tapered chute region gives onto a third region of trough 48, the outboard curl or mouth 74 with a downwardly opening arcuate lip 76. The outboard curl may be considered to commence at the outboard end or margin of apertures 84 noted below.

The chute of trough portion 48 has a base, or bottom portion, 78 and side portions 80, and may include respective inward and outward reliefs 82, and 84 in the nature of apertures. Apertures 82 and 84 are shown as being generally rectangular or square. Although apertures were provided in the embodiment shown and described in U.S. Pat. No. 6,993,892, for the purpose of making the section lighter, the inventor has observed that the horse's tail may tend to become warm, and may after time, be a source of discomfort. As horsehair is relatively insulating in a thermal sense, apertures relatively close to the top edge or margin of the trough, as in U.S. Pat. No. 6,993,892, did not apparently tend to promote cooling very well, if at all. To address this issue, trough portion 48 herein is more open than previously, the openings are larger than previously, and the openings are intended to be placed more predominantly below the tail rather than in the former, high up locations that were predominantly beside the tail. It is thought that this arrangement may tend to give better access for cooling air from below to cool the horse's tail. Trough portion 48 may include a centrally positioned, longitudinally extending external reinforcement rib, or spine, 88, and may include a transversely oriented, integrally formed rib 90 that may emanate from spine 88 and extend peripherally about thereabout from side to side of trough 48 in a U-shape. Rib 90 may be located at a longitudinal station roughly mid-way intermediate base portion 46 and the point of tangency where the downward curvature 92 of mouth 74 of trough 48 that leads to lip 76. Rib 90 may be located between inward relief 82, and outward relief 84. In the embodiment shown, rib 90 is the only laterally extending structural member between inward portion 72 and mouth portion 74. The longitudinal width or thickness $W_{90}$ of rib 90 is less than either the longitudinal length $L_{82}$ of relief 82 or length $L_{84}$ of relief 84. When viewed in bottom view projection, width $W_{82}$ of relief 82 may be wider than spine 88, and may extend lengthwise a distance $L_{82}$ more than double $W_{90}$. Similarly, and again as viewed in bottom view projection, as in FIG. 3*c* the longitudinal extent $L_{82}$ of relief 84 is comparable to, or larger than, the longitudinal extent of rib 90, and the cross-wise projected width $W_{84}$ of relief 84 is comparable to or greater than the projected width of spine 88. As such, more than ⅖ of the projected underside area in trough 48 between inward portion 72 and mouth portion 74 is downwardly open for ventilation, and in the embodiment shown that proportion is greater than ½ of the downwardly projected area in that region, i.e., roughly the total projected area of the region between the left and right hand side portions of trough 48 less the projected area of spine 88 and rib 90. Expressed differently, the solid portion of spine 88 defines less than ⅓ of the total projected width of section in the region of either of apertures 82 and 84.

The upper edges or margins of the side portions 80 of the trough portion 48 are indicated as 94 and 96, and have a profile indicated as 98. Profile 98 includes an outward end portion 100 and an inward portion 102. Outward portion 100 is downwardly concave, with local radii of curvature having local centers of curvature lying below trough portion 48. Inward portion 102 is substantially straight and runs along, and defines the upper edge of, each respective side of trough 48. In contrast to the previous crupper of U.S. Pat. No. 6,993,892, the inventor has found that a larger curl 110 at mouth 74 may be helpful, such that the horse's tail may be less likely to rub on a relatively abrupt end edge and thereby irritate the horse. To that end, the outward facing or upper surface 112 of mouth 74 is formed on a large-radius curve $alpha_{112}$ extending over more than 120 degrees of arc (i.e., more than ⅔(pi) radians), and having a generally downwardly and forwardly (i.e., with a component of direction toward the horse) extending cuff 114, which may extend away from curl 110 on a tangent portion 116 at its distal end. In one embodiment alpha 112 may be about 150 degrees. That is, the outer end portion of crupper 40 has a cross-sectional profile that merges into, or is substantially the same as, that of the intermediate portion of trough 48 more generally. However the outer end of the channel or trough is bent around and somewhat back upon itself on a return angle oriented partially back toward the horse. The end of the tail may then be supported on a well radiused large curve, and in the normal condition the tail may tend to hang vertically under gravity somewhat away from cuff 114 rather than swinging against a sharp edge. In the embodiment shown, there are no apertures in curl 110, such that a continuous, relatively smooth curved surface is presented to the horse's tail, the curve being both in the lengthwise orientation of crupper 40 (and or the horse's tail) and in the cross-wise orientation. Furthermore, trough 48 is wide and deep, with an inside depth that is greater than ⅖ of the width, and the width at mouth 74 being more than ¾ the width of trough 48 at the junction with base portion 46. Thus mouth 74 presents a continuous surface of compound curvature around curl 110, and provides an out-feed or chute or collar, or cuff on the tangent at its outlet. The lip of curl 110, at the end of cuff 114, is also well radiused to be free of sharp edges.

The bottom or forward portion or region 78 of the trough portion 48 and 72 may sometimes be referred to as the "spoon" of the crupper. In the earlier apparatus of U.S. Pat. No. 6,993,892 the inner region of the spoon protruded significantly beyond, or inwardly proud of the surface of the body of revolution of the inner surfaces of pad portions 50, 52. The spoon was also angled upwardly and inwardly relative to the slope of the trough taken along the upper, or inside, surface at the trough centerline. This geometry may not have been as comfortable for the horse as might have been desired. In the embodiment shown herein, trough 48 is substantially spoonless. That is, inner portion 78 extends inwardly proud of pad portions 50, 52 described herein, but less far than the inward surface of the undeflected cushioning or padding 47, 49 on surfaces 56, 58. Expressed differently, the extension distance $d_{78}$ inwardly proud of surfaces 56, 58 is less than the through thickness $t_{50}$ of pad portions 50, 52. Expressed differently again, as a proportion of the width of trough 48 at its inward end, indicated as $W_{48}$, $d_{78}$ may be less than about ⅓ of $W_{48}$, may be in the range of ⅙ to ⅓ of $W_{48}$, and in one embodiment may be about ¼ of $W_{48}$. Moreover, in the embodiment the upper surface of inner portion 78 continues on the same, or substantially the same, slope or curvature as trough 48, rather than having a marked change in curvature, or other distinct deviation upward. That is, in the direction toward the horse it is free up upward slope deviation relative to the inside surface of trough 48 generally, such that no "spoon" shape is formed.

Certain geometric relationships between the forgoing elements may be observed. First, as compared to existing cruppers, the center of gravity CG, of crupper 40, as viewed from the side may tend (a) to be relatively low; and (b) may tend to lie relatively close to the bottom of trough portion 48, and may tend to lie relatively close to the surface of the body of revolution corresponding to the curvature of pad portions 50 and 52.

Although the embodiments illustrated and described above are preferred, the principles of the present invention are not limited to this specific example which is given by way of illustration. It is possible to make other embodiments that employ the principles of the invention and that fall within its spirit and scope as defined by the following claims.

I claim:

1. A tail set crupper comprising:

a base portion and a trough portion;

said base portion having a first surface for placement next to the hindquarters of an animal;

said trough portion being immovably joined to said base portion, the trough portion, in use, extending outwardly away from the animal;

said trough portion having a first end adjoining said base portion, a second end distant from said base portion and a medial portion between said first and second ends;

said second end of said trough portion having a rounded mouth;

said rounded mouth being rounded both lengthwise and cross-wise to present a surface free of abrupt edges to an animal's tail; and said medial portion is predominantly downwardly open for ventilation;

said base portion and said trough portion are joined as parts of a single casting;

said base portion includes left and right hand pads of said casting located to either side of said first end of said trough portion;

said first and second pads have a through-thickness measured to said trough portion; and said first end of said trough portion extends a distance less than said through-thickness proud of said first and second pads.

2. The tail set crupper of claim 1 wherein said trough portion has a spine extending therealong, and apertures are formed in said trough portion adjacent to said spine, said spine being narrower than said apertures.

3. The tail set crupper of claim 1 wherein said trough portion has a central spine and a cross-rib extending between said first end and said second end, and is otherwise downwardly open.

4. The tail set crupper of claim 1 wherein said rounded mouth defines a continuous imperforate rounded surface.

5. The tail set crupper of claim 1 wherein said crupper has a central longitudinal plane, and said rounded mouth presents a continuous rounded surface over a sweep in said central longitudinal plane of more than 2(Pi)/3 radians.

6. The tail set crupper of claim 5 wherein said crupper has an outlet portion extending tangentially away from said continuous rounded surface.

7. The tail set crupper of claim 1 wherein said crupper is substantially spoonless.

8. The tail set crupper of claim 1 wherein said first end of said trough portion is free of upward slope deviation.

9. A tail set crupper comprising:

a base portion and a trough portion;

said base portion having a first surface for placement next to the hindquarters of an animal;

said trough portion being immovably joined to said base portion as a single casting, the trough portion, in use, extending outwardly away from the animal;

said trough portion having a first end adjoining said base portion, a second end distant from said base portion and an intermediate portion between said first and second ends;

said first end of said crupper being substantially spoonless;

said intermediate portion of said trough portion has a bottom portion that is downwardly vented; and said base portion has a through-thickness adjacent to said trough portion, said base portion includes first and second wings extending laterally away from said trough, and said first end of said trough portion extends toward the animal a distance less than said through-thickness proud of said base portion.

10. The tail set crupper of claim 9 wherein said base portion has cushioning applied thereto, and said cushioning stands proud of said first end of said trough portion.

11. The tail set crupper of claim 9 wherein said first end of said trough portion is free of upward slope deviation.

12. A tail set crupper comprising:

a base portion and a trough portion;

said base portion having a first surface for placement next to the hindquarters of an animal;

said trough portion being immovably joined to said base portion, the trough portion, in use, extending outwardly away from the animal;

said trough portion having a first end adjoining said base portion, a second end distant from said base portion and an intermediate portion between said first and second ends; and said crupper having a mouth at said second end thereof, said mouth having the form of a channel defining a continuous support surface, said channel of said mouth being rounded in the cross-wise direction, and said channel having an upwardly facing bottom, and, along a lowermost surface of said upwardly facing channel bottom, said channel being formed on a curve turned back toward said base on a continuous curl.

13. The tail set crupper of claim 12 wherein the curve of the channel is formed on a curl greater than 2(Pi)/3 radians.

14. The tail set crupper of claim 12 wherein said curl of said mouth terminates at a tangentially extending cuff, said cuff being free of a sharp edge.

15. The tail set crupper of claim 12 wherein said channel is at least ⅖ as deep as it is wide.

16. The tail set crupper of claim 12 wherein said trough portion is predominantly vented from underneath.

17. The tail set crupper of claim 12 wherein said crupper is substantially spoonless.

* * * * *